United States Patent [19]

Oglander et al.

[11] 3,941,278

[45] Mar. 2, 1976

[54] LABEL DISPENSING MACHINE

[76] Inventors: Allen H. Oglander, 9 Sackston Woods, St. Louis, Mo. 63141; Richard E. Shannon, 355 Albert, St. Louis, Mo. 63033

[22] Filed: July 10, 1974

[21] Appl. No.: 487,038

[52] U.S. Cl. ..... 221/73

[51] Int. Cl.[2] ..... B65H 5/28

[58] Field of Search ..... 221/70–73

[56] References Cited

UNITED STATES PATENTS

| | | | |
|---|---|---|---|
| 3,186,589 | 6/1965 | West | 221/73 X |
| 3,536,571 | 10/1970 | Groundman | 221/73 X |
| 3,537,933 | 11/1970 | Severance | 221/73 X |

*Primary Examiner*—Robert B. Reeves
*Assistant Examiner*—John P. Shannon
*Attorney, Agent, or Firm*—Ralph W. Kalish

[57] ABSTRACT

A machine for dispensing labels and the like from a backing sheet to which the labels are removably adhered, having side plates with guide rollers extending therebetween for directing the backing sheet through a discharge passage. The end of said discharge passage is provided with a forward leading edge about which the backing sheet is downwardly and rearwardly directed for withdrawing or parting of the sheet from the applied labels. A normally closed microswitch is presented in the path of at least one of such labels for switch opening engagement therewith when such label has projected a preselected distance beyond such leading edge by reason of the parting. A prime mover is in circuit with said switch and is de-energized upon opening of the latter to permit the operator an interval within which to complete the removal of the labels from the sheet, upon which event the switch is restored to closed state and resumption of the backing sheet travel through the machine is effected.

1 Claim, 6 Drawing Figures

LABEL DISPENSING MACHINE

BACKGROUND AND SUMMARY OF THE INVENTION

This invention relates in general to label dispensing, and, more particularly, to a machine for facilitating the removal of adhesive-coated labels from a backing sheet.

It is an object of the present invention to provide a machine which efficiently and reliably promotes the removal of adhesive labels and the like from a backing sheet so that the operator may in a very rapid and certain manner complete the removal without the necessity of effecting an individual, laborious pulling action upon each such label.

It is another object of the present invention to provide a machine of the character stated which is particularly suitable for use with adhesive-coated labels carrying computer supplied intelligence, and being mounted upon data processing paper; there having been heretofore a serious problem for quickly transferring such labels from data processing paper.

It is another object of the present invention to provide a machine of the character stated which may be of any predetermined width for accommodating various types of backing members, and which is useful with such members carrying labels arranged in any preselected number of rows as well as with labels of varying width.

It is a further object of the present invention to provide a machine for label dispensing which obviates the currently accepted practice of transferring such labels through entirely manual operations which are tedious, time-consuming, and most uneconomical.

It is a still further object of the present invention to provide a machine of the character stated which will allow an operator to effect dispensing of the labels in as rapid a manner as may be commensurate with the speed of the machine.

It is another object of the present invention to provide a machine for dispensing labels which is highly durable; which is constituted of a marked simplicity of durable parts; which is resistant to breakdown so that said machine is both economical in production and in operation; and the use of which machine does not require the services of a skilled operator.

DESCRIPTION OF THE PREFERRED EMBODIMENT

Figure 1:
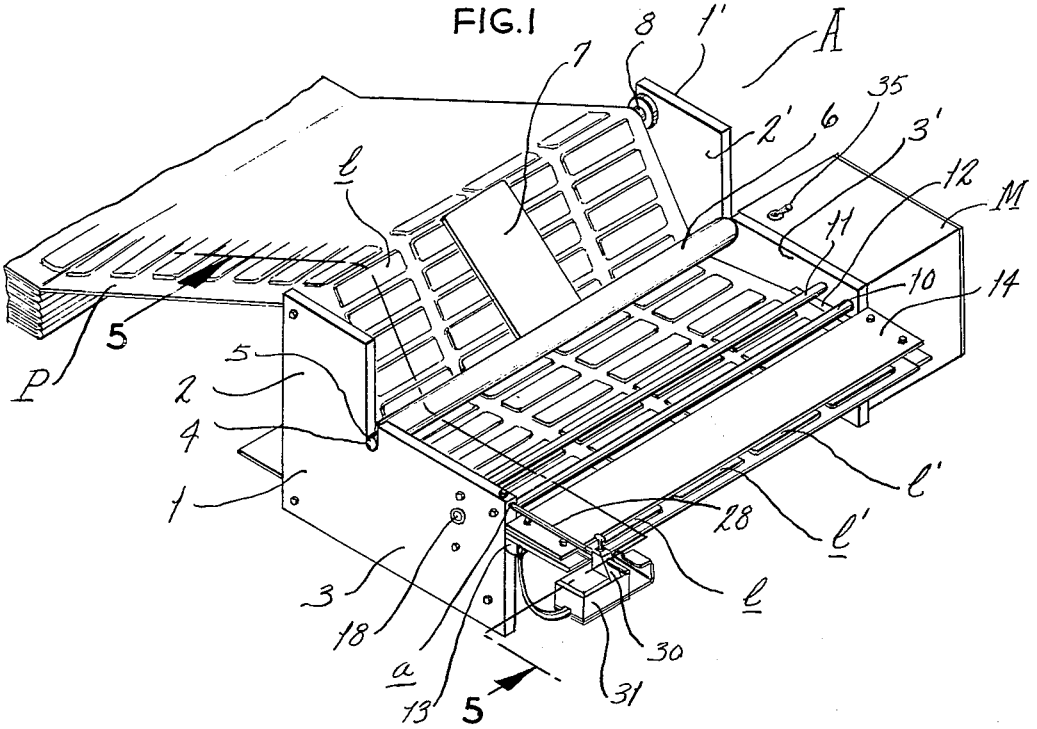
FIG. 1 is a perspective view of a label dispensing machine constructed in accordance with and embodying the present invention, illustrating a label backing sheet fed to the machine.
Figure 2:
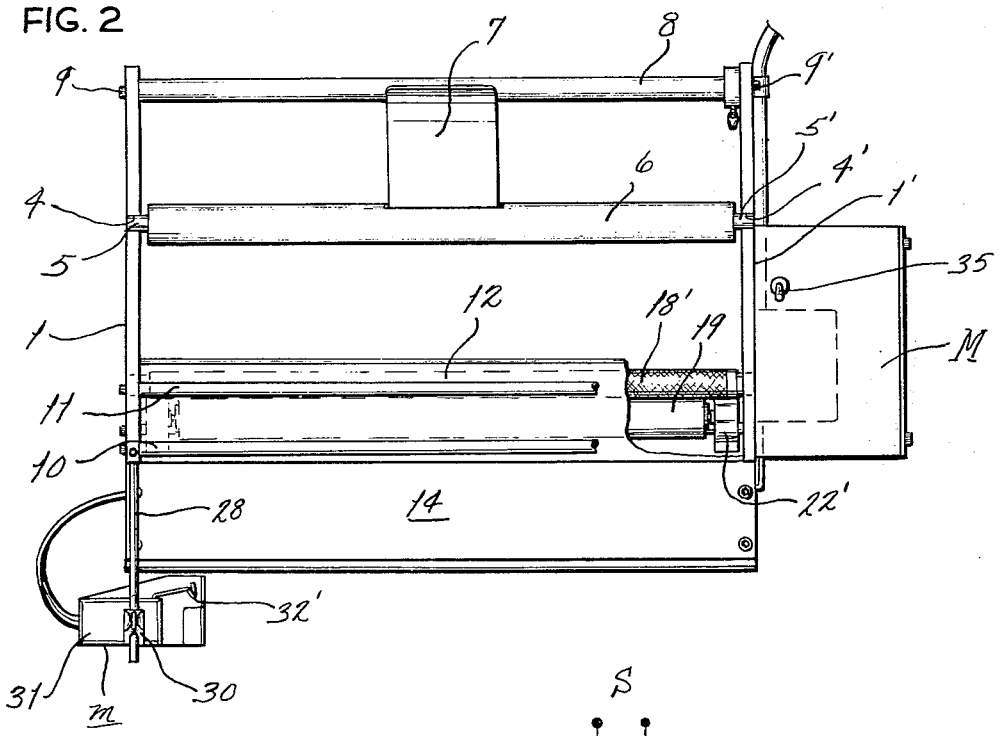
FIG. 2 is a top plan view of the machine.
Figure 6:
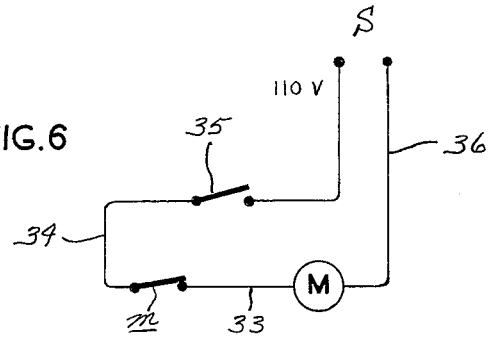
FIG. 6 is a wiring diagram.

Referring now by reference numerals to the drawings which illustrate the preferred embodiment of the present invention, A designates a label dispensing machine having a frame comprised of a pair of opposed, parallel, spaced-apart side plates 1,1' which are of general L-shape having rearward portions 2,2', respectively, of relatively greater height and less width as considered from front to back of the machine, than integral forward portions 3,3', respectively; there being aligned upwardly opening recesses 4,4' in the upper rearward edge extremities of said forward portions 3,3', respectively, for journalling of trunions 5,5', respectively, provided at the opposite ends of a guide or retard roller 6 extending transversely of machine A. Roller 6 intermediate its length is engaged to the lower end of a hold-down or retard plate 7, swingable with roller 6, and the plane of which is normal to the axis thereof. Said hold-down plate 7 is so dimensioned as to extend to a guide rod 8 fixed at its ends in the upper rearward zones of said side plate rearward portions 2,2', as at 9,9', respectively. Thus, through gravity, plate 7 will be normally urged into resting disposition in its upper portion against rod 8 for purposes presently appearing.

Extending transversely between the forward portions 3,3' of side plates 1,1', at their forward upper ends, is a pair of parallel front and back guide rods 10,11 which are disposed immediately above a support plate 12 also extending transversely between said side plates 1,1' and with its rearward edge being located slightly rearwardly of back guide rod 11 and forwardly of guide roller 6. The forward end of support plate 12 projects beyond the forward end edges of side plates 1,1'. Said support plate 12 is accordingly substantially parallel to the machine support surface, such as a bench, table, or the like, as suggested at *s*.

Support plate 12 is mounted upon a bar 13 stably secured upon the forward ends of side plates 1,1' and extending between the same. Immediately forwardly of side plate 1,1', and in overlying relationship to the forwardly projecting portion of support plate 12, and being spaced upwardly thereof a predetermined distance, is a top plate 14 which latter cooperates with support plate 12 to define an intervening discharge passage 15. Top plate 14 is maintained in position by various laterally disposed screws 16 which carry spacers 17 upon their stem portions between top plate 14 and support plate 12.

Presented beneath the rearward end portion of support plate 12, between side plates 1,1', is a drive shaft 18 being suitably journaled at its ends within bearings provided within said side plates 1,1' and being engaged beyond plate 1' to a prime mover or motor M carried within a casing 20 disposed upon the outer face of side plate 1', for purposes of convenience. Fixed upon drive shaft 18 in covering relationship thereto is a drive roller 18', the outer surface of which is desirably knurled or otherwise irregular. Provided for peripheral frictional engagement with drive roller 18' is a driven roller 19 mounted upon a shaft 20 which latter is supported for rotation at its ends within bearings (not shown) formed in the upper ends of arms 22,22'; said latter being located proximate the inner face of side plates 1,1', respectively, and being swingably mounted at their lower ends upon a common shaft 23 fixed at its ends in said side plates 1,1', as at 24, 24', respectively. Within each arm 22,22' there is provided a recess 25 upwardly of shaft 23 for receiving a spring 26 which bears at its lower end against shaft 23 and at its upper end against the adjacent end of said recess 25 thereby preventing longitudinal displacement of said arms 22,22' with respect to shaft 23. Springs 26 thus assure of abutment of roller 19 against drive roller 18' for motion transmission. As may best be seen in FIG. 5, arms 22,22' together with shaft 20, with roller 19 thereon, may be swung forwardly and downwardly away from driving roller 18' for facilitating work feeding purposes, as will be described hereinbelow, and may be accordingly reciprocally swung upwardly and rearwardly for restoring roller 19 and driving roller 18' in frictional engagement. Also extending between arms 22,22' is a roller 27 journaled at its ends in bearing (not shown) provided in said arms 22,22'; said roller 27 being axially parallel to, and normally downwardly of, driven roller 19, and being of reduced diameter relative thereto.

Figure 4:
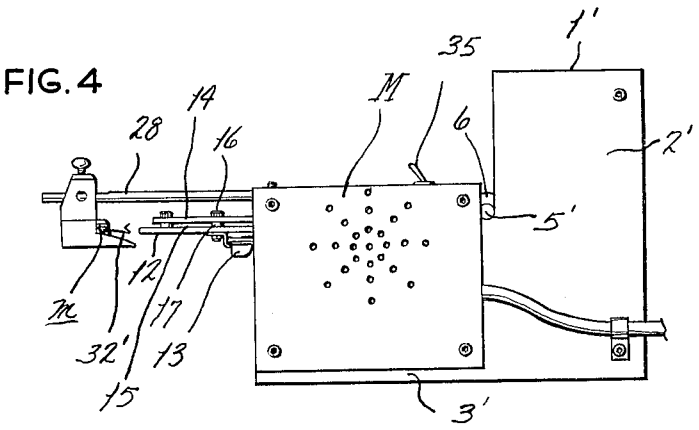
FIG. 4 is a side elevational view taken from the left hand side of FIG. 3.
Figure 3:
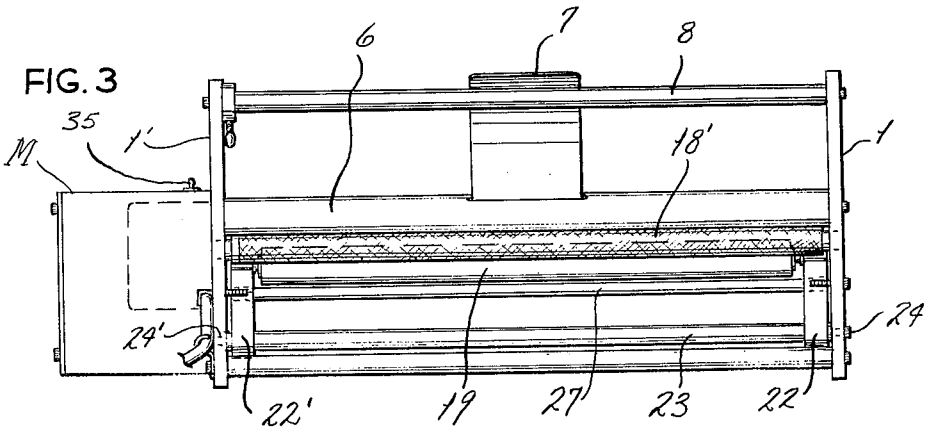
FIG. 3 is a rear elevational view of the machine.

Secured upon side plate 1, as within a socket *a*, in the forward edge thereof, is the rearward end of a mounting rod 28 which extends forwardly of machine A, beyond support plate 12, for relatively slidable projection through an opening 29 within a block 30 surmounting a switch-housing 31; there being an adjustment screw 32 threadedly engaged within said block 30 for securing said housing 31 in preselected positionment upon rod 28. Housing 31 carries a microswitch, indicated *m*, of conventional type, being normally closed, and comprehending an actuating arm 32' which extends rearwardly from housing 31 for alignment with discharge passage 15 but terminating spacedly from the forward end edge of support plate 12 (see FIG. 4). Microswitch *m* is connected at one side by a conductor 33 to prime mover M and at its other side is in circuit through a lead 34 with one side of a control switch 35, which latter may be of the toggle type as shown in FIG. 4. The other side of control switch 35 is connected to one side of a convenient source S of voltage, such as 110 volts, while the other side of prime mover M is connected to the other side of such source by a lead 36. Accordingly, prime mover M may be provided with electrical energy from the usual wall outlet, as customarily found in business and residential establishments.

In operation, a length of backing material, indicated P, having applied thereon discrete adhesive-coated labels *l*, as in a plurality of longitudinally extending, side-by-side rows, is fed to machine A. Said backing P may be provided in a multiplicity of folded sections as is usual with data processing paper, or, of course, may be in roll form, if desired; with the degree of adherence of labels *l* being such as to allow removal of the same from said backing P for ultimate adherence under pressure to a carrier. Thus, labels *l* may be of the type having computer applied addresses for use upon mailing pieces, etc. However, it is to be understood that labels *l* are merely exemplary of any type of adhesive-coated unit removably mounted upon a suitable backing. Also, the illustration of backing P having a plurality of rows of labels *l* is also only for purposes of illustration since any desired arrangement of labels *l* may be presented so that machine A is of sufficient versatility for accommodating any preselected optional presentation of labels *l*.

Figure 5:
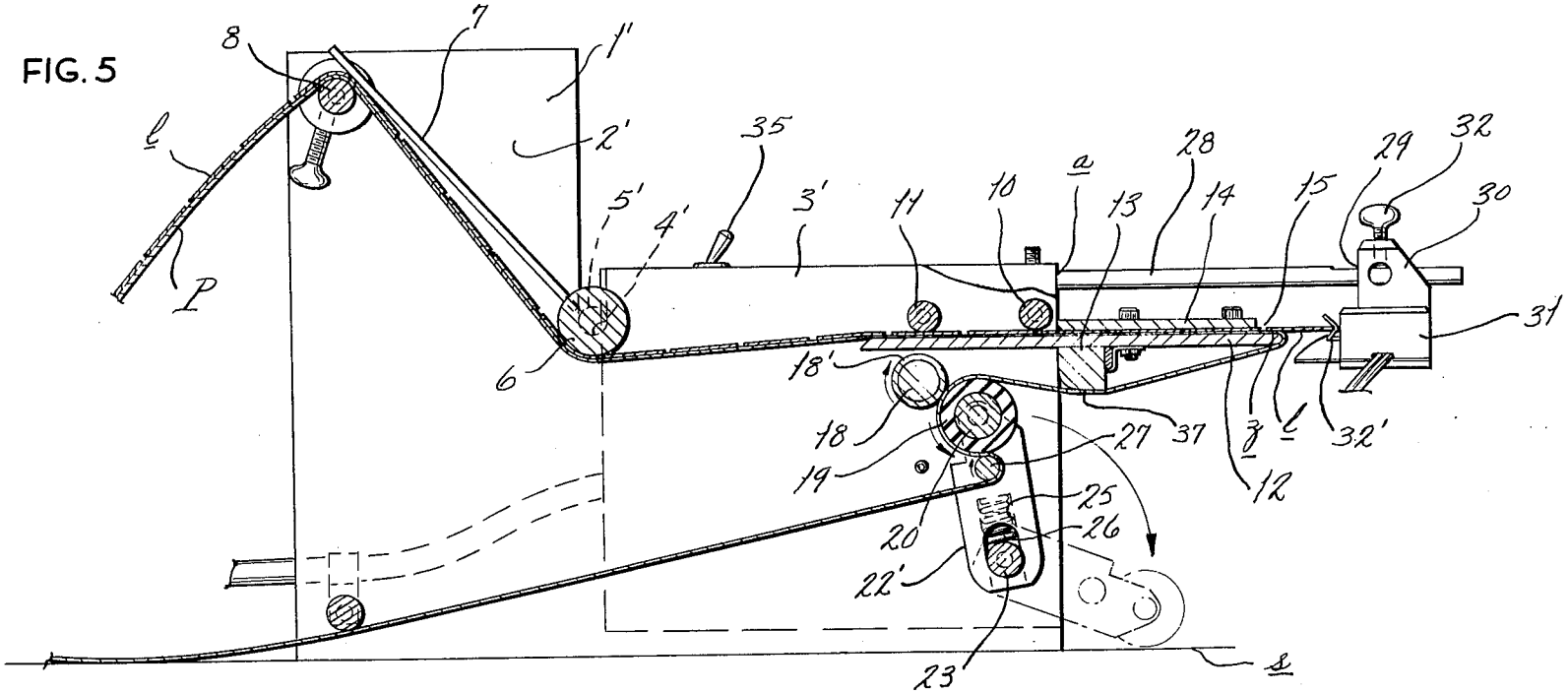
FIG. 5 is a vertical transverse sectional view taken on the line 5—5 of FIG. 1.

Backing P is fed to machine A so as to be directed over guide rod 8 and led thence downwardly and forwardly beneath guide roller 6; with hold-down plate 7 resting against backing P upon guide rod 8 with the force thereby applied being sufficient to cause backing P to be in a relatively taut condition, but without preventing travel of the same over rod 8. From guide roller 6, backing P is directed forwardly onto support plate 12, beneath guide rods 10, 11 and thence through discharge passage 15. At the forward end of support plate 12, backing P is then directed against the forward end edge of said support plate 12 and thence led downwardly and rearwardly for contacting the undersurface of a guide block 37 supported by bar 13. From block 37 backing P is then led slightly upwardly and rearwardly for disposition over driven roller 19; and therefrom forwardly over guide roll 27 and thence rearwardly to a suitable point of collection (not shown). With arms 22,22' swung upwardly and rearwardly, backing P is thus brought into immediate forceful contact against drive roller 18. The rearward canting of arms 22, 22' in upward or operational position assures of a gravitational force for producing the requisite pressure between drive roller 18 and driven roller 19. With backing P so presented to machine A, control switch 35 is closed whereupon prime mover M is energized and driving roller 18 is caused to rotate, as in a clockwise direction as viewed in FIG. 5. Upon rotation of driving roller 18, backing P is pulled, as it were, through friction, about driven roller 19 which is caused to rotate in a counterclockwise direction, as seen in FIG. 5, so that said backing P is thus drawn forwardly through discharge passage 15.

As backing P is pulled over and about the forward end edge of support plate 12 the same is drawn or peeled away from the overlying label of labels *l* which continue forward travel beyond support plate 12. The particular label *l* whose forward path is obstructed by switch actuating arm 32 will deflectingly engage same to cause microswitch *m* to open thereby opening the circuit through prime mover M which is caused to stop. At such juncture it will be seen that the particular label *l* engaging actuating arm 32, and any and all labels *l'* transversely aligned with said particular label *l*, will be in projected position beyond the forward end edge of support plate 12 and hence substantially unsupported and exposed for facile grasping by the operator who will thus easily remove same manually from backing P. Immediately upon removal, the particular label *l* which had been in contact with switch arm 32', the latter will, through its bias, return to switch-closed condition thereby causing a re-energizing of prime mover M with the pulling of backing P through machine A being resumed for continuation until actuating arm 32' has been pushed into switch-open condition by the next successive label. Thereupon, again, prime mover M will stop, allowing the operator to readily peel the partially parted, exposed labels *l* in the next transverse row from backing P. Accordingly, such cyclic sequence is repeated as long as the operator desires, and with the speed of operation being dependent upon the dexterity and agility of the operator.

From the foregoing it will be seen that the operator, of course, will remove initially those labels which are not in contact with trigger arm 32' and removing the one in such contact lastly in view of the fact that the same effectively controls the prime mover M. As suggested in FIG. 5, the location of actuating arm 32' with respect to the forward leading edge of support plate 12 will be determined by many obvious factors, such as the size of the labels *l*, the character of the adhesive, etc. Thus, such distance which is easily determined, will allow for sufficient forward travel of labels *l* so that the same are substantially removed from backing P, yet are retained thereto by a limited zone of adherence, such as suggested at *z* in FIG. 5 in order that minimum effort is required to complete the parting while preventing full displacement of such labels *l* from backing P prior to operator removal.

From the foregoing, it is quite apparent that machine A provides a very simple, but highly efficient automatic means for initiating, as well as substantially effecting, the removal of labels *l* from backing P so that the operator may very quickly strip same from backing P in a rapid manner, but yet with the operator being able to effectively control the speed of the label removing action by virtue of effectively determining the time interval utilized for completing same. Also, it should be obvious that machine A is extremely versatile, being adapted for effecting the partial, or even total, removal of adhesive coated labels from a backing member and the use of which thus eliminates the heretofore accepted time-consuming practice of manually stripping each individual label from a backing sheet which has proved most uneconomical.

Having described our invention what we claim and desire to obtain by Letters Patent is:

1. A label dispensing machine for use with a sheet-like backing having discrete label-forming members removably adhesively secured to at least one face thereof comprising a frame having spaced apart side plate, having aligned forward end edges, a support plate extending transversely between the forward portions of said side plates in planar perpendicular relationship thereto, said support plate projecting forwardly beyond the forward end edges of said side plates, the forward end edge of said support plate defining a parting edge, a top plate provided spacedly above the forward end portion of said support plate in spaced apart relationship to define therewith an intervening discharge passage for said backing, a prime mover mounted on said frame, a guide rod extending between said side plates in their upper, rearward portions, a roller extending between said side plates in their central portion, downwardly of said guide rod and rearwardly of said support plate, a hold down plate mounted on said roller being of such length as to extend upwardly beyond said guide rod to maintain the backing thereover in taut condition, a shaft extending between said side plates beneath the rearward portion of said support plate and being engaged to said prime mover for rotation upon energization of the latter, a driven roller extending between said side plates beneath said support plate and peripherally engageable with said shaft, means for swinging said driven roller away from said shaft for facilitating backing feeding therebetween, an arm fixed to the forward end of one of said side plates and projecting forwardly therefrom in elevated relationship to the underlying portion of said support plate, said arm extending beyond said support plate, a switch housing adjustably mounted upon said arm in its extended portion for selected disposition therealong toward and away from said support plate, a normally closed control switch carried in said switch housing, said switch having an actuating arm for disposition within the path of travel of a label-forming member upon movement of the backing member downwardly and rearwardly about said parting edge, circuit means connecting said prime mover and said switch whereby said sheet-like backing member is directed over said guide rod downwardly beneath said roller and thence through said discharge passage, thence downwardly and rearwardly about the parting edge of the support plate for engagement between said shaft and said driven roller with said prime mover being controlled by the engagement of a parted label with the said switch actuating arm for opening of the switch to stop the prime mover for withdrawal of the parted label-forming members.

* * * * *